US006536046B1

(12) United States Patent
Gilligan

(10) Patent No.: US 6,536,046 B1
(45) Date of Patent: Mar. 25, 2003

(54) BASEBALL GLOVE

(75) Inventor: Lawrence J. Gilligan, Ringwood, NJ (US)

(73) Assignee: Akadema, Inc., Garfield, NJ (US)

( * ) Notice: Subject to any disclaimer, the term of this patent is extended or adjusted under 35 U.S.C. 154(b) by 0 days.

(21) Appl. No.: 10/143,711

(22) Filed: May 9, 2002

(51) Int. Cl.[7] ..... A41D 13/08
(52) U.S. Cl. ..... 2/19; 2/161.1
(58) Field of Search ..... 2/19, 16, 158, 2/159, 161.1; D2/616, 617

(56) References Cited

U.S. PATENT DOCUMENTS

| | | | | |
|---|---|---|---|---|
| 2,558,544 | A | | 6/1951 | Delsalle |
| 2,625,686 | A | | 1/1953 | Latina |
| 3,051,958 | A | | 9/1962 | Latina |
| 3,098,234 | A | | 7/1963 | Latina |
| 3,169,250 | A | | 2/1965 | Heiman |
| 3,300,787 | A | | 1/1967 | Denkert |
| 4,279,681 | A | | 7/1981 | Klimezky |
| 4,346,481 | A | | 8/1982 | Latina |
| 4,461,043 | A | | 7/1984 | Lomedico |
| 4,630,318 | A | | 12/1986 | Aoki |
| 4,847,915 | A | | 7/1989 | Keene |
| 4,987,611 | A | | 1/1991 | Maye |
| 5,168,578 | A | | 12/1992 | Stanley |
| 5,379,459 | A | * | 1/1995 | Williams, Jr. ..... 2/161.1 |
| 5,572,739 | A | | 11/1996 | Kolada et al. |
| 5,604,934 | A | | 2/1997 | Willett |
| 5,678,245 | A | | 10/1997 | Rector et al. |
| 5,687,421 | A | | 11/1997 | Murai |
| 5,694,641 | A | | 12/1997 | Doi et al. |
| 5,706,519 | A | | 1/1998 | Cooper |
| 5,878,436 | A | * | 3/1999 | Jones ..... 2/19 |
| 6,041,438 | A | | 3/2000 | Kirkwood |
| 6,154,882 | A | | 12/2000 | Ullman |
| 6,182,289 | B1 | * | 2/2001 | Brown ..... 2/161.1 |
| 6,253,382 | B1 | | 7/2001 | Kleinert |
| 6,260,198 | B1 | | 7/2001 | LoMedico |
| 6,289,515 | B1 | * | 9/2001 | Fous ..... 2/19 |

* cited by examiner

*Primary Examiner*—Gary L. Welch
(74) *Attorney, Agent, or Firm*—Kaplan & Gilman, LLP; Michael R. Gilman, Esq.

(57) ABSTRACT

A flexible baseball glove is provided. The glove comprises front and back shells which are joined together both along the periphery of the glove and selectively at internal portions of the glove, in such a manner as to form a finger portion, a heel portion and a thumb portion thereof. A web-type panel is disposed between the finger portion and thumb portion and at least two finger stalls and one thumb stall are formed within the glove, between the joined front and back shells. A first finger stall of the at least two finger stalls is closed, so that fingers of the users hand cannot be received into that stall. The glove also comprises first and second hinge assemblies located along the heel portion, wherein one of the hinge assemblies is closer in proximity to the thumb portion of the glove, while the other hinge assembly is closer in proximity to the finger portion of the glove.

34 Claims, 3 Drawing Sheets

BASEBALL GLOVE

BACKGROUND OF THE INVENTION

This invention relates to the field of baseball gloves, and more particularly, to baseball gloves that are designed to facilitate better control and ease of use of the glove by the player who is using the glove.

Baseball gloves are as old as the game itself. Yet many improvements have been made in baseball gloves over these many years as the game itself has become both quicker and harder to play due to technological advances in the construction of both baseballs and baseball bats, and also due to the higher level of fitness, strength and size of today's baseball players. In order to keep up with these subtle, yet ever present, changes in the way the game is played, baseball gloves have also needed to evolve.

Some obvious changes that came to pass over the years in the design and construction of baseball gloves for professional baseball centered around the change of design between a catcher's glove, first baseman's glove and gloves worn by the rest of the players. As the game developed and became more popular and a realization of the specialty characteristics of the catcher and first baseman positions became more evident, the gloves for these positions also adapted and changed more rapidly than for other positions. In particular, as most people know today, a catcher's glove is far different in shape, composition and purpose, than are the gloves of any of the other positions on the field, while this is also true, but to a lesser extent, for a first baseman's glove.

As the game further developed over the years, and as we are presently situated, there are specialty gloves for essentially all of the classified positions: catcher, first baseman, infield (consisting of second base, shortstop and third base), pitcher and outfield.

While any baseball glove (except possibly for a catcher's glove), could today be used by the standard weekend warrior at any position, without regard to whether the glove is specially designed for a particular position on the field, the subject invention is directed to a glove to be used in a higher level of play; such as by high school, collegiate or professional players. In particular, the subject baseball glove is more specifically directed to a more highly flexible outfielders glove for use by such high school, collegiate and professional players in order to facilitate the "trapping" of the ball securely within the glove after it is caught by the outfielder.

Over the years, other gloves have been designed to be more flexible, and whether they have achieved this result or not is not known (but is considered irrelevant), as their construction is significantly different than the construction of the subject baseball glove invention.

U.S. Pat. No. 4,346,481, issued in 1982 to Latina, and is directed to a baseball mitt, and in particular a catcher's mitt designed to be more flexible due to the positioning of a glove 11 secured to the back of the mitt body 5. Essentially, the '481 patent discloses that glove 11 is oriented on the back of mitt 1, in such a way that the normal mechanical opening of a person's hand is more directly aligned with the single hinge-line 31 of the mitt. As will be discussed below, while the ultimate result of the construction of the mitt of the '481 patent is somewhat similar to the end result of the end construction of the subject invention, significant differences in that construction exist so as not to render the disclosure of the '481 patent relevant in this matter.

U.S. Pat. No. 4,847,915, issued in 1989 to Keene, for a baseball glove with a flexible heel construction. Here also, while the '915 patent discusses a more flexible glove, this is where the similarities to the subject invention end. The '915 patent specifically discusses achieving a flexibility in the heel portion of the glove for use by children and young adults, while also discussing a single hinge-line 59 for the glove.

U.S. Pat. No. 5,694,641, issued in 1997 to Doi et. al., for a flexing baseball glove. The '641 patent shows the cooperation between a hole 8 located along the hingeline of the glove and the extension portion 4, to allow for the increased flexibility of the glove. The subject invention has no such hole or extension portion to assist in its flexibility.

Accordingly, while each of the above cited patents possibly achieve increased flexibility to the glove through their particular constructions, it would also be desirable to achieve higher flexibility in a baseball glove without the added smoke and mirrors of the above discussed prior art, in a baseball glove that is more conventionally constructed.

SUMMARY OF THE INVENTION

In accordance with the invention, a flexible baseball glove is provided. The glove comprises front and back shells which are joined together both along the periphery of the glove and selectively at internal portions of the glove, in such a manner as to form a finger portion, a heel portion and a thumb portion thereof. A web-type panel is disposed between the finger portion and thumb portion and at least two finger stalls and one thumb stall are formed within the glove, between the joined front and back shells. A first finger stall of the at least two finger stalls is closed, so that fingers of the users hand cannot be received into that stall. The glove also comprises first and second hinge assemblies located along the heel portion, wherein one of the hinge assemblies is closer in proximity to the thumb portion of the glove, while the other hinge assembly is closer in proximity to the finger portion of the glove.

Accordingly, it is an object of the invention to provide an improved baseball glove.

Still another object of the invention is to provide an improved baseball glove that is more flexible in its use to a higher level of player, such as a high school, collegiate or professional player.

Yet a further object of the invention is to provide an improved baseball glove for an outfielder, where the fingers of the user's hand which are within the glove are shifted further from the thumb of the user's hand to achieve a stronger closing action.

Still a further object of the invention is to provide an improved baseball glove having two hinge assemblies along the heel of the glove, instead of the normally found single hinge assembly.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
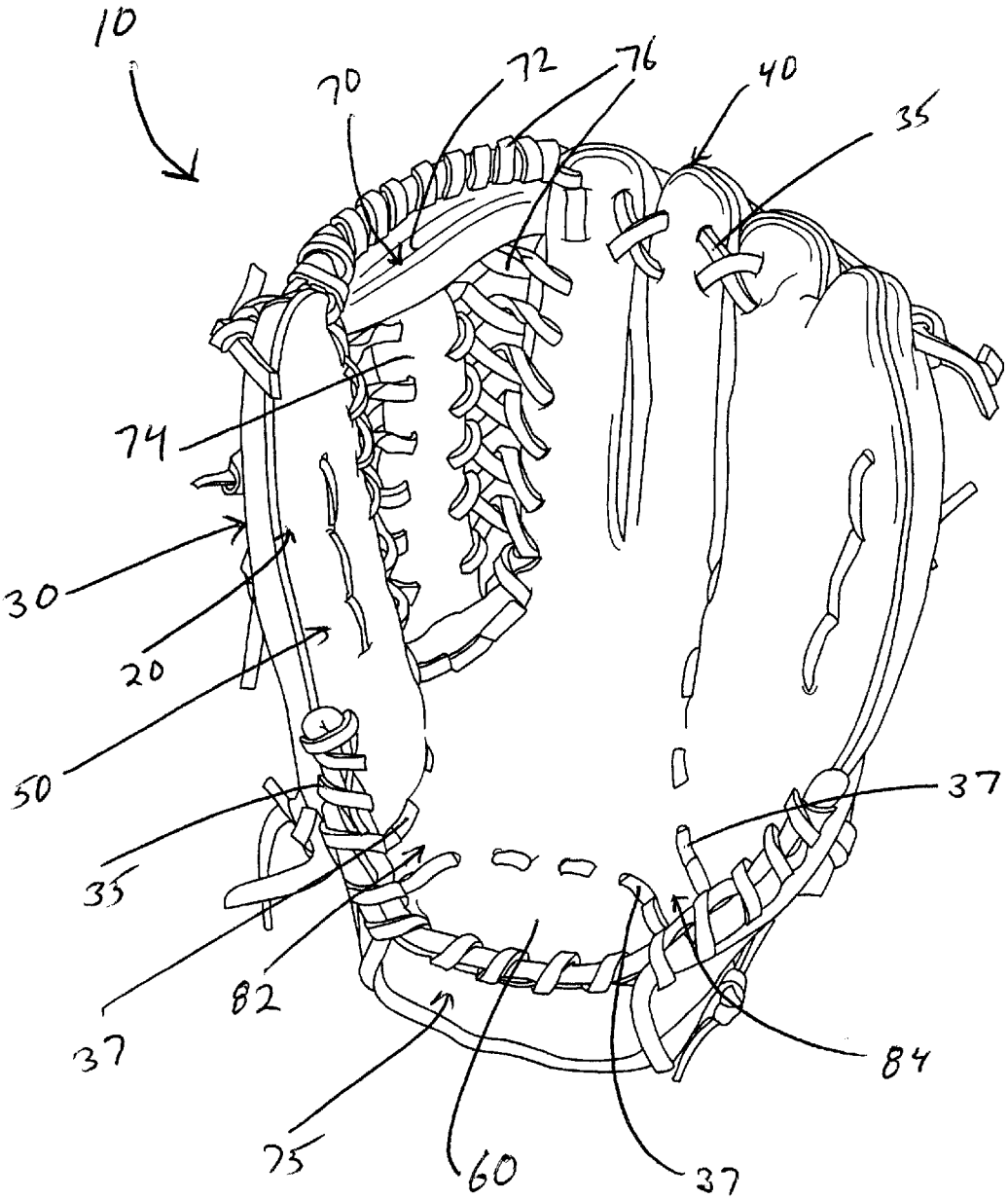
FIG. 1 is a front elevational view of the baseball glove of the subject invention showing, in phantom, the shifted finger positioning of the fielder's fingers, as well as the two hinge assemblies located at opposite ends of the heel portion of the glove.

Referring to the figures, a baseball glove made in accordance with the subject invention is shown at 10. Glove 10 has a front shell 20 and a back shell 30. As is ordinary and customary in the baseball glove industry, front shell 20 is joined to back shell 30 in various locations along the shells' peripheries and internally, away from the various peripheral edges of the shells, by lacing 35 and 37. It is to be understood that other lacing, and even stitching, can be found on glove 10, but are not shown in the figures, and that only representative lacing is actually shown.

The joining of shells 20 and 30 create the essential format of the glove, specifically, finger portion 40, thumb portion 50 and heel portion 60. Disposed between finger portion 40 and thumb portion 50 is web-type panel 70. Web-type panel 70 preferably consists of first and second leather elements 72 and 74, stitched together in such a way as to form the shape of the letter "t". This "t"-shaped element is secured to glove 10 at finger portion 40 and thumb portion 50 through use of lacing 76. It is to be understood that the subject invention can incorporate any form of web-type panel 70 that might already be known and used in the baseball trade, or that may not be presently known or used, but is created in the future.

The joining together of shells 20 and 30 also creates opening 75 below heel portion 60. It is through opening 75 that a user of glove 10 inserts his/her hand so as to be able to use glove 10 while playing baseball.

Figure 2:
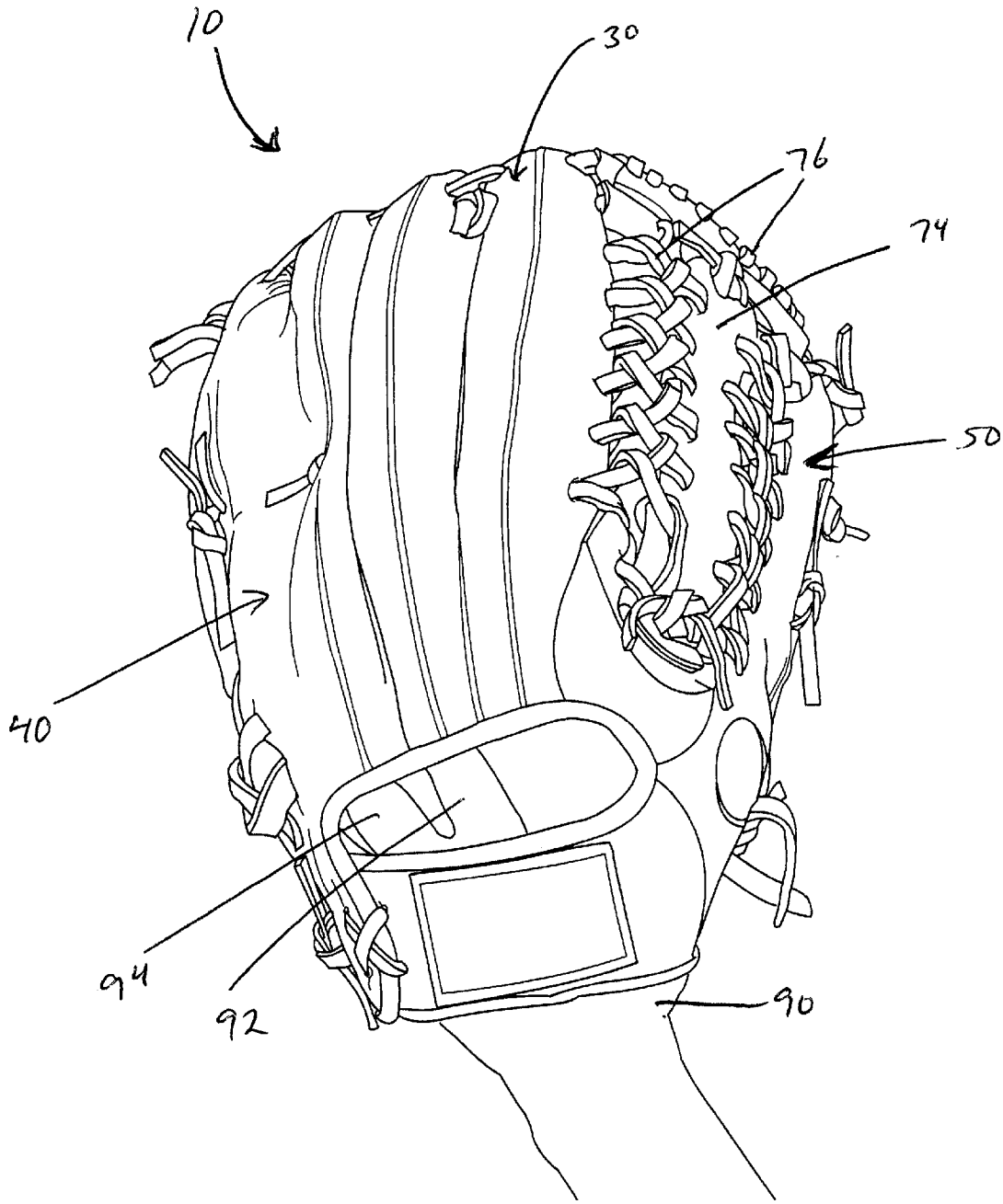
FIG. 2 is a front elevational view of the baseball glove of the subject invention, showing in cutout the particular finger placement within the finger and thumb stalls, as well as the closed-off finger stall.
Figure 3:
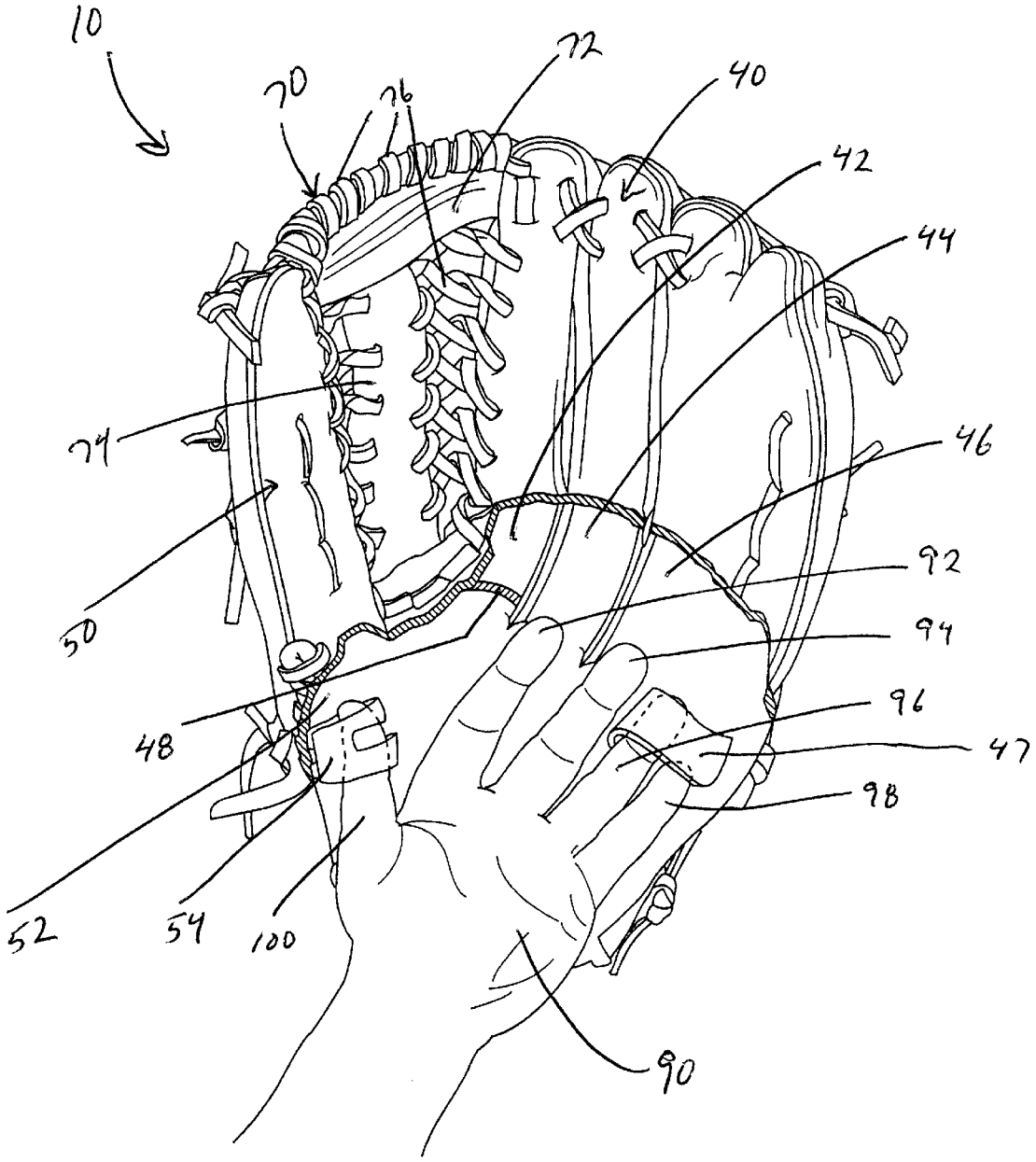
FIG. 3 is a rear elevational view of the same glove showing, in phantom, the user's hand and the closed off stall.

As is known in the art, when the person's hand is inserted into a typical prior art baseball glove, the person's four fingers and one thumb are usually each received into their own individual finger stall. In the subject invention, however, and as is best seen in FIG. 2, finger stall 42 of finger portion 40 is closed off at blocking element 48, so that no finger of the user's hand may enter stall 42. Accordingly, the person's index/pointer finger 92 is forced to be received into finger stall 44; which is normally the finger stall into which the person's middle finger 94 would be received. Instead, since finger 92 is moved from stall 42 to 44, the person's remaining three fingers (middle finger 94, ring finger 96 and pinky finger 98), are received into single stall 46. It is also to be understood that it is possible not to have finger stalls 44 and 46 separate, but to have them 25 combined into one large stall (not shown). In this latter case, glove 10 would still have at least two finger stalls, but finger stall 42 would be closed and therefore not useable, leaving only one useable stall.

Continuing with FIG. 2, on the other side of glove 10 is thumb portion 50, having thumb stall 52.

It is also seen that within finger stall 46 and thumb stall 52, there are finger hammocks 47 and 54, respectively, for receiving fingers 96 and 98 and thumb 100 therethrough, respectively. It is to be understood that finger hammock 47 can either be larger or smaller, so as to allow for all three fingers (94, 96 and 98), or just finger 98 to be positioned therethrough.

Turning now again to FIG. 1, it is seen that glove 10 has a double hinge construction at heel portion 60. In particular, as is shown in FIG. 1, a hinge assembly 82 is found along heel portion 60 in closer proximity to thumb portion 50 then to finger portion 40, and a hinge assembly 84 is in closer proximity to finger portion 40 then it is to thumb portion 50. Both of hinge assemblies 82 and 84 of constructed in a manner commonly know in the baseball glove field, and it is anticipated herein that any such earlier known construction, or any construction of the future, is incorporated into this invention.

In all known prior art baseball gloves, only one hinge assembly is located along the heel portion; usually closer in proximity to the finger portion of the glove then to the thumb portion of the glove. It is evident that a second hinge assembly located closer to thumb portion 50, will allow the user to more easily close glove 10 with his/her hand 90, as such a second hinge assembly creates a second, needed, natural bending location for the glove. Accordingly, and with the existence of second hinge assembly 82, the user finds it easier to flex finger and thumb portions 40 and 50, respectively, toward each other, to close glove 10 around a caught baseball.

Finally, and in addition to the double hinge assemblies 82 and 84 creating a more flexible glove design, the combination of this double hinge design and the closure of finger stall 42 (which forces the user's hand into a stronger closing position (as is discussed in more detail above)), creates an even easier flexing glove 10.

It is also to be understood that between front shell 20 and back shell 30 are found various padding and stiffening elements (not shown), which help to protect the player's hand from injury and to strengthen glove 10.

It will thus be seen that the objects set forth above, among those made apparent from the preceding description, are efficiently attained, and since certain changes may be made in the above constructions without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A baseball glove, comprising:

a front shell for fielding a baseball thereon;

a back shell substantially joined to said front shell in such manner as to form a finger portion, a heel portion and a thumb portion of said glove, and further defining an opening below said heel portion for receiving therethrough a hand of a user of said glove;

a web-type panel disposed between said finger portion and said thumb portion; and at least two finger stalls and one thumb stall formed within said glove, between said substantially joined front and back shells, wherein:

a first finger stall of said at least two finger stalls is closed, so that fingers of said hand of said user of said glove cannot be received within said first finger stall;

said fingers of said hand of said user of said glove are received into said at least two finger stalls, other then said first finger stall; and a thumb of said hand of said user of said glove is received into said thumb stall.

2. A baseball glove as recited in claim 1, wherein said front and back shells are substantially joined along select peripheral sections of said front and back shells.

3. A baseball glove as recited in claim 2, wherein said front and back shells are further substantially joined through select intermediary sections of said front and back shells.

4. A baseball glove as recited in claim 1, said at least two finger stalls comprising said first finger stall, a second finger stall and a third finger stall.

5. A baseball glove as recited in claim 4, wherein a pointer finger of said fingers of said hand of said user is received into said second finger stall and a middle finger, ring finger and pinky finger of said fingers of said hand of said user are received into said third finger stall.

6. A baseball glove as recited in claim 5, further comprising hinge means along said heel portion of said glove, for facilitating easier folding of said glove around said baseball when said baseball is on said front shell, or in said web-type panel, of said glove.

7. A baseball glove as recited in claim 6, said hinge means comprising first and second hinge assemblies, said first hinge assembly closer in proximity then said second hinge assembly to said thumb portion of said glove and said second hinge assembly closer in proximity then said first binge assembly to said finger portion of said glove.

8. A baseball glove as recited in claim 1, said finger portion comprising a single finger element and a unitary finger element, said single finger element located between said web-type panel and said unitary finger element and terminating at a peripheral end thereof in a single fingertip, and said unitary finger element terminating with three fingertips at a peripheral end thereof.

9. A baseball glove as recited in claim 8, wherein said first finger stall is located within said single finger element.

10. A baseball glove, comprising:

a front shell for fielding a baseball thereon;

a back shell substantially joined to said front shell in such manner as to form a finger portion, a heel portion and a thumb portion of said glove, and further defining an opening below said heel portion for receiving therethrough a hand of a user of said glove;

a web-type panel disposed between said finger portion and said thumb portion;

at least two finger stalls and one thumb stall formed within said glove, between said substantially joined front and back shells; and first and second hinge assemblies located along said heel portion of said glove for facilitating easier folding of said glove around said baseball when said baseball is on said front shell, or in said web-type panel, of said glove, said first hinge assembly closer in proximity then said second hinge assembly to said thumb portion of said glove and said second hinge assembly closer in proximity then said first hinge assembly to said finger portion of said glove.

11. A baseball glove as recited in claim 10, wherein:

a first finger stall of said at least two finger stalls is closed, so that fingers of said hand of said user of said glove cannot be received within said first finger stall;

said fingers of said hand of said user of said glove are received into said at least two finger stalls, other then said first finger stall; and a thumb of said hand of said user of said glove is received into said thumb stall.

12. A baseball glove as recited in claim 11, said at least two finger stalls comprising said first finger stall, a second finger stall and a third finger stall.

13. A baseball glove as recited in claim 12, wherein a pointer finger of said fingers of said hand of said user is received into said second finger stall and a middle finger, ring finger and pinky finger of said fingers of said hand of said user are received into said third finger stall.

14. A baseball glove as recited in claim 10, wherein said front and back shells are substantially joined along select peripheral sections of said front and back shells.

15. A baseball glove as recited in claim 14, wherein said front and back shells are further substantially joined through select intermediary sections of said front and back shells.

16. A baseball glove as recited in claim 10, said finger portion comprising a single finger element and a unitary finger element, said single finger element located between said web-type panel and said unitary finger element and terminating at a peripheral end thereof in a single fingertip, and said unitary finger element terminating with three fingertips at a peripheral end thereof.

17. A baseball glove as recited in claim 16, wherein said first finger stall is located within said single finger element.

18. A baseball glove, comprising:

a front shell for fielding a baseball thereon;

a back shell substantially joined to said front shell in such manner as to form a finger portion, a heel portion and a thumb portion of said glove, and further defining an opening below said heel portion for receiving therethrough a hand of a user of said glove;

a web-type panel disposed between said finger portion and said thumb portion; and first, second and third finger stalls and one thumb stall formed within said glove, between said substantially joined front and back shells, wherein said first finger stall is closed, so that fingers of said hand of said user of said glove cannot be received within said first finger stall, a pointer finger of said hand of said user of said glove is received into said second finger stall, a middle finger, ring finger and pinky finger of said hand of said user of said glove are received into said third finger stall and a thumb of said hand of said user of said glove is received into said thumb stall.

19. A baseball glove as recited in claim 18, wherein said front and back shells are substantially joined along select peripheral sections of said front and back shells.

20. A baseball glove as recited in claim 19, wherein said front and back shells are further substantially joined through select intermediary sections of said front and back shells.

21. A baseball glove as recited in claim 18, further comprising hinge means along said heel portion of said glove, for facilitating easier folding of said glove around said baseball when said baseball is on said front shell, or in said web-type panel, of said glove.

22. A baseball glove as recited in claim 21, said hinge means comprising first and second hinge assemblies, said first hinge assembly closer in proximity then said second hinge assembly to said thumb portion of said glove and said second hinge assembly closer in proximity then said first hinge assembly to said finger portion of said glove.

23. A baseball glove as recited in claim 18, said finger portion comprising a single finger element and a unitary finger element, said single finger element located between said web-type panel and said unitary finger element and terminating at a peripheral end thereof in a single fingertip, and said unitary finger element terminating with three fingertips at a peripheral end thereof.

24. A baseball glove as recited in claim 23, wherein said first finger stall is located within said single finger element.

25. A baseball glove, comprising:

a front shell for fielding a baseball thereon;

a back shell substantially joined to said front shell in such manner as to form a finger portion, a heel portion and a thumb portion of said glove, and further defining an opening below said heel portion for receiving therethrough a hand of a user of said glove;

a web-type panel disposed between said finger portion and said thumb portion;

at least two finger stalls and one thumb stall formed within said glove, between said substantially joined front and back shells, wherein:

a first finger stall of said at least two finger stalls is closed, so that fingers of said hand of said user of said glove cannot be received within said first finger stall;

said fingers of said hand of said user of said glove are received into said at least two finger stalls, other then said first finger stall; and a thumb of said hand of said user of said glove is received into said thumb stall; and first and second hinge assemblies located along said heel portion of said glove for facilitating easier folding of said glove around said baseball when said baseball is on said front shell, or in said web-type panel, of said glove, said first hinge assembly closer in proximity then said second hinge assembly to said thumb portion of said glove and said second hinge assembly closer in proximity then said first hinge assembly to said finger portion of said glove.

26. A baseball glove as recited in claim 25, wherein said front and back shells are substantially joined along select peripheral sections of said front and back shells.

27. A baseball glove as recited in claim 26, wherein said front and back shells are further substantially joined through select intermediary sections of said front and back shells.

28. A baseball glove as recited in claim 25, said finger portion comprising a single finger element and a unitary finger element, said single finger element located between said web-type panel and said unitary finger element and terminating at a peripheral end thereof in a single fingertip, and said unitary finger element terminating with three fingertips at a peripheral end thereof.

29. A baseball glove as recited in claim 28, wherein said first finger stall is located within said single finger element.

30. A baseball glove, comprising:

a front shell for fielding a baseball thereon;

a back shell substantially joined to said front shell in such manner as to form a finger portion, a heel portion and a thumb portion of said glove, and further defining an opening below said heel portion for receiving therethrough a hand of a user of said glove;

a web-type panel disposed between said finger portion and said thumb portion;

first, second and third finger stalls and one thumb stall formed within said glove, between said substantially joined front and back shells, wherein said first finger stall is closed, so that fingers of said hand of said user of said glove cannot be received within said first finger stall, a pointer finger of said hand of said user of said glove is received into said second finger stall, a middle finger, ring finger and pinky finger of said hand of said user of said glove are received into said third finger stall and a thumb of said hand of said user of said glove is received into said thumb stall; and first and second hinge assemblies located along said heel portion of said glove for facilitating easier folding of said glove around said baseball when said baseball is on said front shell, or in said web-type panel, of said glove, said first hinge assembly closer in proximity then said second hinge assembly to said thumb portion of said glove and said second hinge assembly closer in proximity then said first hinge assembly to said finger portion of said glove.

31. A baseball glove as recited in claim 30, wherein said front and back shells are substantially joined along select peripheral sections of said front and back shells.

32. A baseball glove as recited in claim 31, wherein said front and back shells are further substantially joined through select intermediary sections of said front and back shells.

33. A baseball glove as recited in claim 30, said finger portion comprising a single finger element and a unitary finger element, said single finger element located between said web-type panel and said unitary finger element and terminating at a peripheral end thereof in a single fingertip, and said unitary finger element terminating with three fingertips at a peripheral end thereof.

34. A baseball glove as recited in claim 33, wherein said first finger stall is located within said single finger element.

* * * * *